US006718009B1

(12) United States Patent
Khounsary

(10) Patent No.: US 6,718,009 B1
(45) Date of Patent: Apr. 6, 2004

(54) METHOD OF MAKING OF COMPOUND X-RAY LENSES AND VARIABLE FOCUS X-RAY LENS ASSEMBLY

(75) Inventor: Ali Khounsary, Hinsdale, IL (US)

(73) Assignee: The University of Chicago, Chicago, IL (US)

( * ) Notice: Subject to any disclaimer, the term of this patent is extended or adjusted under 35 U.S.C. 154(b) by 25 days.

(21) Appl. No.: 10/243,559

(22) Filed: Sep. 13, 2002

(51) Int. Cl.[7] ..... G21K 1/06
(52) U.S. Cl. ..... 378/84; 378/85; 378/145
(58) Field of Search ..... 378/84, 85, 145

(56) References Cited

U.S. PATENT DOCUMENTS 6,091,798 A * 7/2000 Nygren et al. ..... 378/84
6,269,145 B1 * 7/2001 Piestrup et al. ..... 378/81
6,385,291 B1 5/2002 Takami ..... 378/84

OTHER PUBLICATIONS

B. Lengeler et al.,"Transmission and gain of singly and doubly focusing refractive x–ray lenses" in J. of Applied Physics, vol. 84, No. 11, pp. 5855–5861 (Dec. 1, 1998).
B. Lengeler et al.,"Imaging by parabolic refractive lenses in the hard X–ray range" in J. Synchroton Rad., 6, pp. 1153–1167 (1999).
B. Lengeler et al., "A microscope for hard x rays based on parabolic compound refractive lenses" in Applied Physics Letters, vol. 74, No. 26, pp. 3924–3926 (Jun. 28, 1999).
J.T. Cremer et al., "Cylindrical compound refractive x–ray lenses using plastic substrates" in Review of Scientific Instruments, vol. 70, No. 9 pp. 3545–3548 (Sep. 1999).
M.A. Piestrup et al., "Two–dimensional x–ray focusing from compound lenses made of plastic" *in Review of Scientific Instruments*, vol. 71, No. 12 pp. 4375–4379 (Dec. 2000).
R.H. Pantell et al., "The effect of unit lens alignment and surface roughness on x–ray compound lens performance" in Review of Scientific Instruments, vol. 71, No. 1 pp. 48–52 (Jan. 2001).
B. Lengeler et al., "Parabolic refractive X–ray lenses", in J. Synchroton Rad., 9, pp. 119–124 (2002).
C.G. Schroer et al., "High resolution imaging and lithography with hard x–rays using parabolic compound refractive lenses" in Review of Scientific Instruments, v ol. 73, No. 3 pp. 1640–1642 (Mar. 2002).

* cited by examiner

*Primary Examiner*—Craig Church
*Assistant Examiner*—Jurie Yun
(74) *Attorney, Agent, or Firm*—Joan Pennington

(57) ABSTRACT

A method for producing microstructures for use for x-ray lenses using extrusion techniques and a variable focus x-ray lens assembly are provided. An elongated strip of multiple x-ray lenses and cavities of arbitrary cross-section are produced by an extrusion step. A predefined lens profile of the multiple x-ray lenses has, for example, a parabolic profile for x-ray focusing. The elongated strip of multiple cylindrical compound x-ray lenses can be cut into multiple uniform small lengths, for example, 50 mm lengths, and positioned within a support member. Cutting the assembled support member and x-ray lenses at a selected angle provides a variable focus x-ray lens assembly.

20 Claims, 4 Drawing Sheets

METHOD OF MAKING OF COMPOUND X-RAY LENSES AND VARIABLE FOCUS X-RAY LENS ASSEMBLY

CONTRACTUAL ORIGIN OF THE INVENTION

The United States Government has rights in this invention pursuant to Contract No. W-31-109-ENG-38 between the United States Government and Argonne National Laboratory.

FIELD OF THE INVENTION

The present invention relates to a new and improved method of making of compound x-ray lenses and a new and improved variable focus x-ray lens assembly.

DESCRIPTION OF THE RELATED ART

X-ray lenses are used to focus x-ray beams produced, for example, with synchrotron and lab-based x-ray sources. X-ray beams can be focused by a variety of mechanisms including mirror, crystals, zone plates, and capillaries. However, since the real part of the index of refraction decrement of materials for x-rays is very, very small, and negative, ($\sim -10^{-8}$ to $-10^{-6}$) it is necessary, respectively, to use several aligned lenses to affect significant x-ray focusing, and x-ray focusing generally requires concave rather than convex-shaped lenses.

A variety of methods for the fabrication of an x-ray focusing lens system composed of several double-sided concave lenses have been suggested. If one-dimensional focusing is sought, then a substrate with a number of aligned cylindrical holes drilled into it can be used. Presently, cylindrical holes of circular cross-section are used for one-dimensional x-ray focusing because they are easy to make. To reduce spherical aberrations in x-ray focusing, it is better to use parabolic-shaped cylinders, rather than circular. Normal drilling cannot produce non-circular-shaped cylinders. If two-dimensional focusing is desired, then spherical or paraboloidal cavities must be configured.

A principal object of the present invention is to provide a new and improved method of making x-ray lenses and a new variable focus x-ray lens assembly.

It is another object of the invention to provide such method of making x-ray lenses and variable focus x-ray lens assembly that requires no or minimal alignment of individual lenses, has substantially smooth walls, has minimal x-ray absorption, and that is easy and economical to manufacture.

It is another object of the invention to provide such method of making x-ray lenses and variable focus x-ray lens assembly that facilitates forming the x-ray lenses of different materials, the x-ray lenses having arbitrary lens profiles, and the use of an arbitrary number of x-ray lenses for variable focusing.

It is another object of the invention to provide method of making x-ray lenses and variable focus x-ray lens assembly substantially without negative effect and that overcome many of the disadvantages of prior arrangements.

SUMMARY OF THE INVENTION

In brief, a method for producing microstructures for use for x-ray lenses using extrusion techniques and a variable focus x-ray lens assembly are provided. An elongated strip containing a series of aligned cylindrical compound x-ray lenses is formed by extrusion. A predefined lens profile of the cylindrical compound x-ray lenses has, for example, a parabolic profile for x-ray focusing.

In accordance with the invention, the elongated strip contains a series of aligned x-ray lenses formed of selected metals, plastics, ceramics and compounds and produced by an extrusion step. For focusing low to moderate energy x-rays, materials having low atomic numbers are used. The elongated strip of multiple cylindrical x-ray lenses can be cut into multiple, generally uniform small lengths, and positioned within a support member. Cutting the assembled support member and x-ray lenses at a selected angle provides a variable focus x-ray lens assembly.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
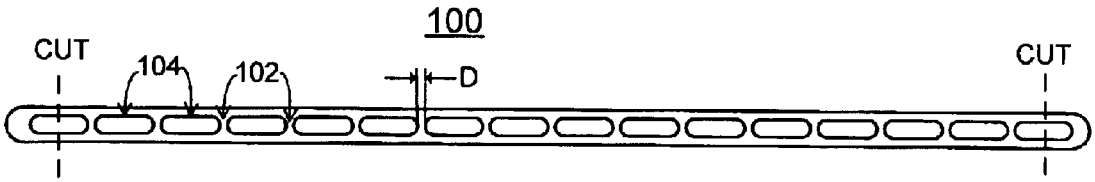
FIG. 1 is an enlarged front view illustrating an extruded lens strip of multiple x-ray lenses in accordance with the preferred embodiment.

Having reference now to the drawings, in FIG. 1 there is shown not to scale an enlarged front view of an extruded lens strip generally designated by the reference numeral 100 and arranged in accordance with the preferred embodiment. The extruded lens strip 100 is an elongated strip including a plurality of cylindrical x-ray lenses 102 defined by a plurality of cavities 104. Each of the multiple cylindrical x-ray lenses 102 has a predefined lens profile for x-ray focusing.

In accordance with features of the invention, the extruded lens strip 100 can be formed with the cylindrical compound x-ray lenses 102 having an arbitrary cavity profile. A circular lens produces spherical aberration that can be improved by using a parabolic profile, and for this reason a parabolic (or other optimally profiled) lens advantageously forms the cylindrical x-ray lenses 102. The predefined lens profile of the multiple cavities 104 advantageously has, for example, a parabolic or other optimally designed lens profiles.

The extrusion process of the preferred embodiment provides a very economical method of producing x-ray lenses 102. It is also a very effective technique for large-scale production of these lenses 102. Massive number of lenses 102 can be produced in a single fabrication run. Large-scale use of the extruded lenses 102 is enabled, not only on synchrotron beamline applications but also on many thousands of lab-based x-ray sources.

An extrusion technique that can be used for forming the extruded lens strip 100 of a plurality of cylindrical x-ray lenses 102 is known as hot micro extrusion. In hot extrusion of hollow or tubular profiles, a die (not shown) is used that has openings corresponding to the negative of the part to be made. Allowance for thermal shrinkage and other effects are made in the die design. By pushing heated soft material, such as aluminum, into the die, soft aluminum flows around the bridge supporting the mandrel and into the openings in the die. The open sections metallurgically join prior to exiting the die assembly to make the desired part. After cooling, the long, extruded section or lens strip 100 can be cut into desired lengths. It should be understood that injection molding could be used.

Figure 2:
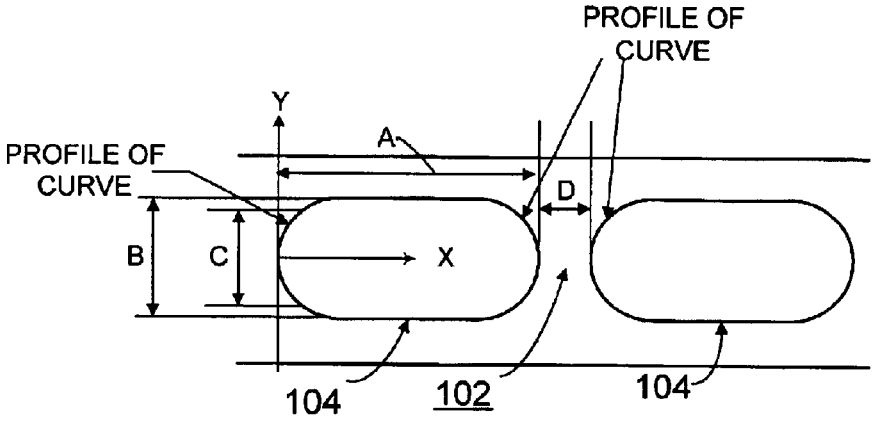
FIG. 2 is an enlarged front view illustrating two exemplary cavities defining lens of the extruded lens strip of FIG. 1 in accordance with the preferred embodiment.

Referring also to FIG. 2, there is shown not to by two exemplary cavities 104 defining the double concave cylindrical x-ray compound lens 102 of the extruded lens strip 100. The cavity 104 has an overall width indicated by a line A and an overall height indicated by a line B. Only opposing vertical cavity portions labeled PROFILE OF CURVE defining the double concave cylindrical x-ray lens 102 and within a line labeled C interact with x-ray beam and are important for x-ray focusing. The shape of the opposing vertical cavity lens profiles of the cylindrical x-ray lens 102 defined by cavities 104 is parabolic, although more rigorous calculations may indicate other profiles that can be produced in accordance with the method of the present invention. The opposing vertical cavity lens profiles of the x-ray lens 102 of the preferred embodiment also can be circular. By using extrusion for forming the lens strip 100, various arbitrary shaped lens profiles of the cylindrical x-ray lens 102 can easily be provided with an appropriately shaped die.

As shown in FIG. 2, the upper and lower surfaces of the cavities 104 defining the cylindrical x-ray lens 102 are substantially flat. The upper and lower portions of the cavities 104 and the cylindrical compound x-ray lens 102 are not important for focusing and could have any configurations. The opposing vertical cavity focusing portions have generally smooth walls. A distance between adjacent cylindrical x-ray cavities 104 indicated by a line D in FIGS. 1 and 2 and known as wall thickness is made small to minimize on-axis x-ray absorption.

The focal distance F of an array of a compound x-ray lens is given by:

$$F=R/2N\delta$$

where R is the radius of curvature of the cavity in the region where the beam strikes it, N is the number of the cavities, and $\delta$ is the real part of the index of refraction increment n given by $n=1-\delta+i\beta$. Preferably, a parabolic (or other optimally designed) cross-section is needed to focus a beam from a source. Thus an extrusion die with a parabolic (or other) cross-section advantageously is used to form each cylindrical x-ray lens 102 within the extruded lens strip 100.

From the simple equation given above for the focal distance, it is clear that the smaller the radius of curvature, (at x=0, y=0 in FIG. 2), the fewer the cavities needed to achieve a given focusing power. However, a larger lens 102 is easier to fabricate. A compromise radius, for example, on the order of 0.5 to 1 mm (diameters of 1–2 mm in an equivalent circular cross-section) may be preferred. An x-ray beam striking the parabolic profile portion typically is approximately 0.5 mm high and a round 1–10 mm deep. It is preferred that the extruded lens strip 100 be about twice or more thicker than the cavity size to give the part mechanical integrity and maintain lateral alignment.

The wall thickness between adjacent cylindrical cavities 104 is made as thin as possible, for example, in an ideal range between 10–200 $\mu$m depending on the material. By stretching the extruded lens strip 100, for example, by 10–50%, the wall thickness between adjacent cylindrical x-ray lenses 102 can be reduced. The predefined lens profile of the multiple cylindrical compound x-ray lenses 102 in the extruded lens strip 100 should be optimized such that the final lens strip 100 after stretching has the desired lens profile with a thinner wall thickness.

For focusing low to moderate energy x-rays, extruded lens strip 100 is formed of a selected material and compounds having a low atomic number elements. The selected material includes, for example, Li, Al, other metals, plastics, ceramics and compounds. This is because of heavy absorption of such x-rays in heavier metals. For higher x-ray energies (30–500 keV or more) heavier elements and compounds can be used for forming extruded lens strip 100.

Brazeway Inc., of Adrian, Mich., has formed the extruded lens strip 100 of the preferred embodiment using an extrusion die. Aluminum was selected as the material of choice for its softness and ability to be easily extruded. It is desirable that the material should not have high concentrations of heavier elements. The roughness of the lens 102 of aluminum extruded strip 100 is acceptable for x-ray focusing.

It should be understood that additional processing steps could be performed to enhance characteristics of the cylindrical x-ray lenses 102, such as, etching inside the lenses 102 can be performed to improve surface smoothness and other attributes, for example, profile.

Figure 3:
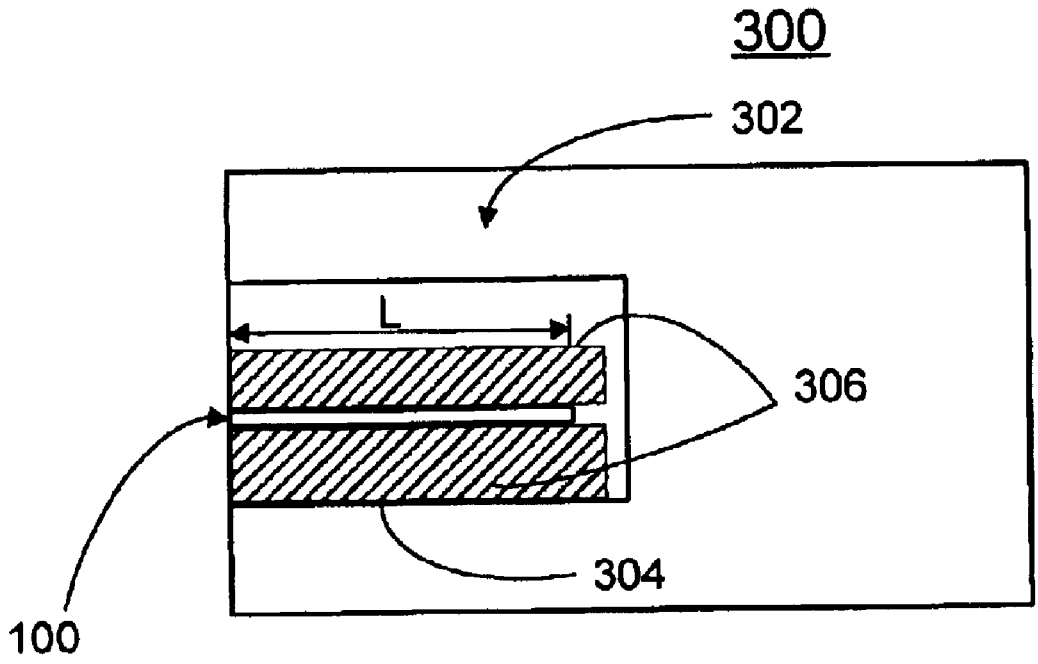
FIG. 3 is a side view illustrating an exemplary initial assembly of a support member and one or multiple extruded lens strips of FIG. 1 in accordance with the preferred embodiment.
Figure 4:
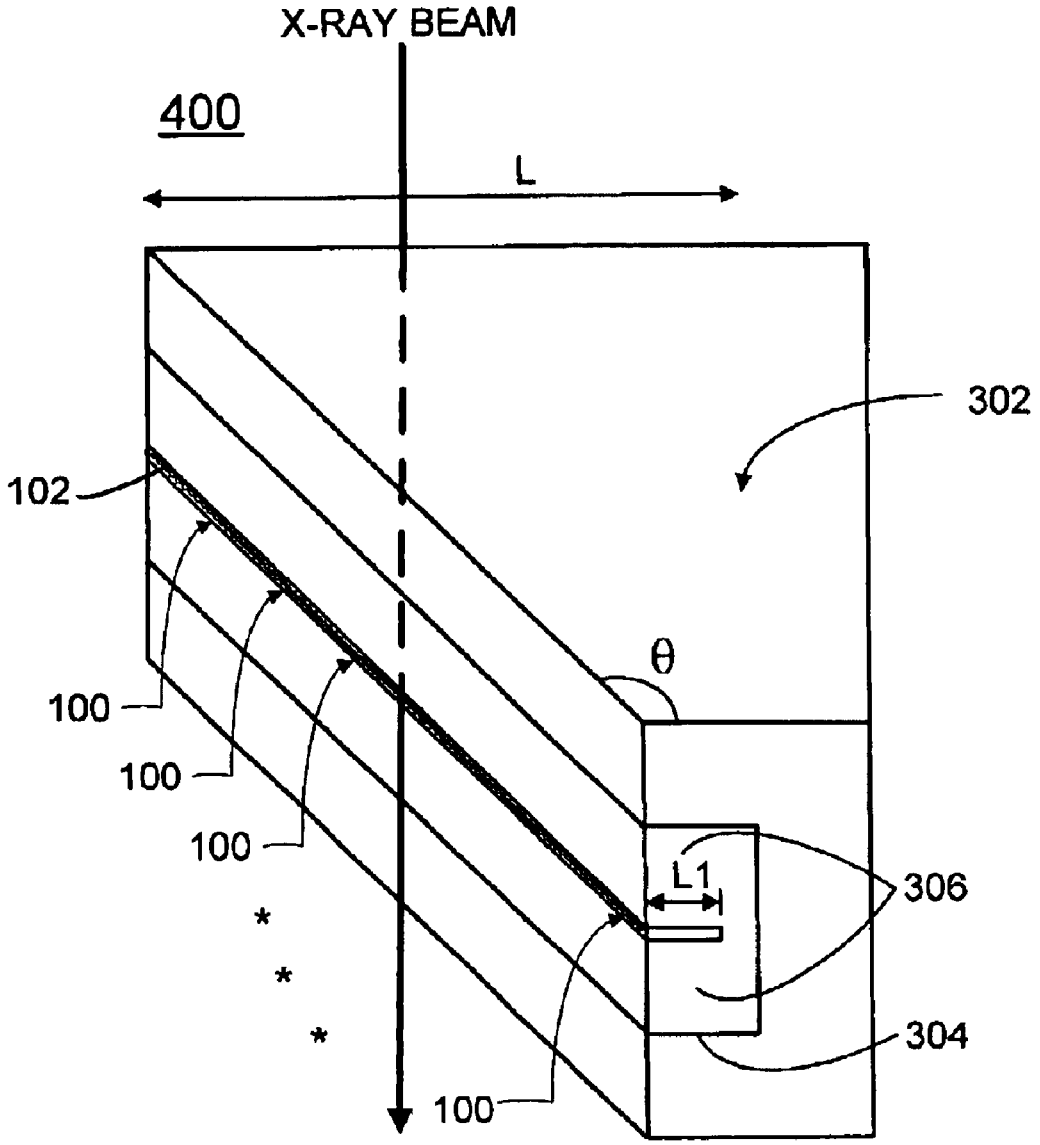
FIG. 4 is a perspective view illustrating an exemplary variable focus x-ray lens assembly formed from the exemplary initial assembly of FIG. 3 in accordance with the preferred embodiment.

Referring now to FIGS. 3 and 4, one or more of the extruded lens strips 100 are used for forming a variable focus x-ray lens assembly 400 of the preferred embodiment shown in FIG. 4.

FIG. 3 illustrates an exemplary initial assembly 300 of a support member 302 and one or more extruded lens strips 100 in accordance with the preferred embodiment. The elongated strip 100 of multiple cylindrical x-ray lenses 102 can be cut into multiple, generally uniform small lengths, for example, 50 mm lengths. Selected lens strips 100 of cylindrical x-ray lenses 102 are cut as indicated at lines labeled CUT in FIG. 1, for example, by electric discharge machining (EDM) to achieve generally packed spacing between the cylindrical x-ray lenses 102 within the initial assembly 300. The support member 302 has an overall generally rectangular shape and defines a long rectangular shaped slot 304 for receiving a series of generally aligned lens strips 100. Multiple lens strips 100 of cylindrical x-ray lenses 102 having generally uniform lengths as indicated by arrow labeled L are positioned within the slot 304 in the support member 302, sandwiched between spacer materials or members 306, to achieve and maintain alignment between the cylindrical x-ray lenses 102 within the initial assembly 300. Spacer members 306 are substantially flat and can be of hardened steel, aluminum, or others. Set screws (not shown) can be used for mounting the spacer members 306 containing the lens strips 100 of cylindrical x-ray lenses 102 within the long rectangular shaped slot 304.

Each of the multiple lens strips 100 can contain, for example, between 5 and 30 cylindrical x-ray lenses 102. While one row of cylindrical x-ray lenses 102 is shown in the exemplary lens strip 100 in FIG. 1, it should be understood that multiple rows of cylindrical compound x-ray lenses 102 could be formed in accordance with the present invention. The initial assembly 300 of the support member 302 and the multiple aligned extruded lens strips 100 can contain, for example, between 20 and 300 cylindrical compound x-ray lenses 102.

FIG. 4 illustrates the exemplary variable focus x-ray lens assembly 400 formed from the exemplary initial assembly 300 of FIG. 3 in accordance with the preferred embodiment. The initial assembly 300 is diagonally cut, for example, by electric discharge machining (EDM) to form the variable focus x-ray lens assembly 400 having a selected angle θ. The length of the series of cylindrical x-ray lenses 102 linearly decreases from the initial length L at a first x-ray beam receiving side of the variable focus x-ray lens assembly 400 to a smaller length indicated by L1 at the opposing side of the variable focus x-ray lens assembly 400. The smaller length L1 is determined by the selected angle θ of the resulting overall geometry of the variable focus x-ray lens assembly 400.

It should be understood that the present invention is not limited to the illustrated exemplary variable focus x-ray lens assembly 400 of FIG. 4. For example, the length of the series of cylindrical x-ray lenses 102 could be arranged to decrease in steps along straight or curved lines from the initial length L to a final smaller length L1, rather than using a single selected angle θ as shown in FIG. 4.

In operation, the variable focus x-ray lens assembly 400 is moved horizontally across the x-ray beam for selectively focusing the incident x-ray beam vertically at different locations. The horizontal positions of the variable focus x-ray lens assembly 400 with respect to the incident x-ray beam determines the variable number of the series of cylindrical x-ray lenses 102 that interact with the x-ray beam for selectively focusing the incident x-ray beam vertically at different locations. For example, as shown in FIG. 4, the variable focus x-ray lens assembly 400 could be moved horizontally in the left direction relative to the illustrated x-ray beam to increase the number of the series of cylindrical x-ray lenses 102 that interact with the x-ray beam. Alternatively, to decrease the number of the series of cylindrical x-ray lenses 102 that interact with the x-ray beam, the variable focus x-ray lens assembly 400 is moved horizontally in the right direction relative to the illustrated x-ray beam as shown in FIG. 4.

Key advantages in extruding x-ray lenses of the preferred embodiment are low cost and the ability to produce multiple x-ray cylindrical lenses 102 with parabolic or other cross-sections. Production of multiple x-ray cylinders 102 with parabolic or other cross-sections with most other methods is complex and generally expensive. It should be understood that two orthogonal sets of lenses 102 could be used for additional focusing by providing two orthogonal variable focus x-ray lens assemblies 400.

It should be understood that elongated, arbitrary-shaped cylindrical lenses 102 of the preferred embodiment can include multiple different shaped cylindrical lenses 102, each having selected different lens profiles. It should be understood that elongated, arbitrary-shaped cylindrical lenses 102 of the preferred embodiment could be thermally, hydraulically, and structurally optimized to be used for various diverse applications, for example, as heat pipes In the form of long strips 100 or formed coils.

Figure 5:
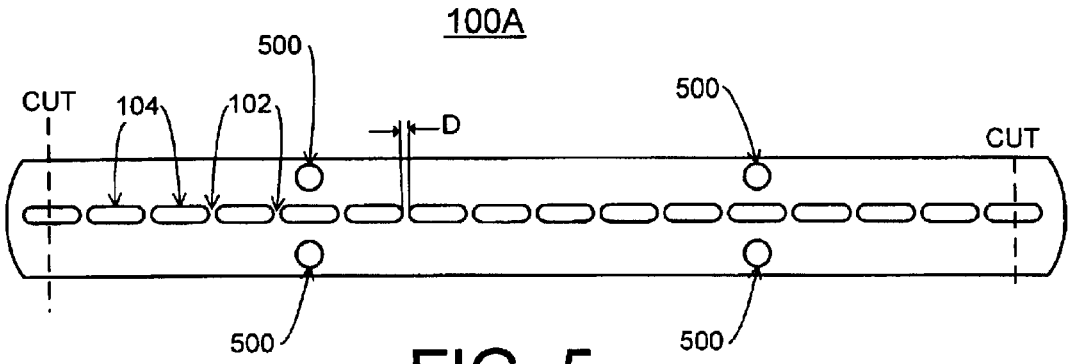
FIG. 5 is an enlarged front view illustrating an alternative extruded lens strip of multiple cylindrical x-ray lenses and including cooling channels in accordance with the preferred embodiment.

FIG. 5 is an enlarged front view illustrating an alternative extruded lens strip generally designated by reference character 100A further including cooling channels 500 in accordance with the preferred embodiment. The channels 500 can be implemented for example, for cooling, in the same substrate for high heat load x-ray applications. In particular, cooling channels 500 can be formed in the extruded lens strips 100A, such as, at selected positions in the strip 100, for example, above, below or at extreme left or right of the multiple cylindrical x-ray lenses 102 in one step during extrusion. When cooling channels 500 are added, the overall vertical dimension of the lens strip 100B should be, for example, about double that of lens strip 100 in FIG. 1. Generally, there will be more than four cooling channels 500, tailored to the needs of a particular application.

Figure 6:
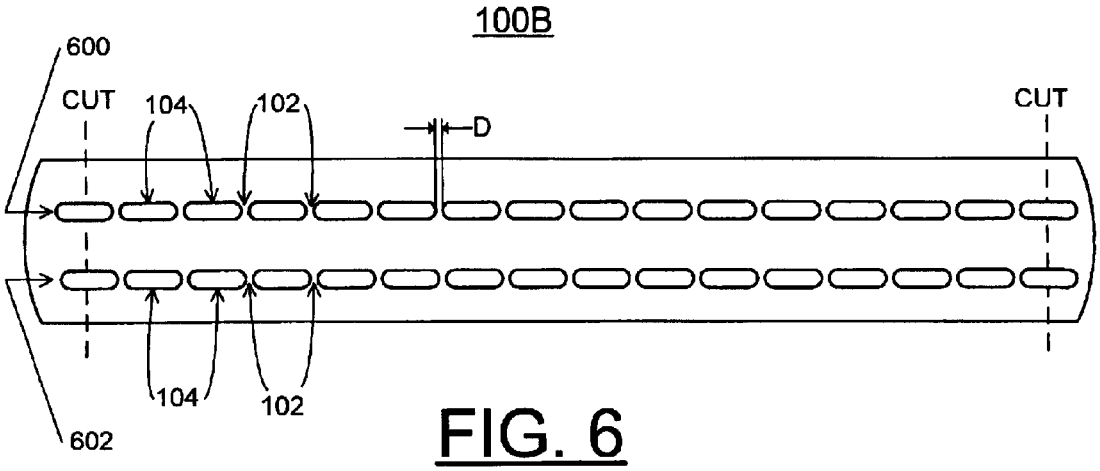
FIG. 6 is an enlarged front view illustrating another alternative extruded lens strip of first and second sets of multiple x-ray lenses in accordance with the preferred embodiment.

FIG. 6 is an enlarged front view illustrating another alternative extruded lens strip generally designated by reference character 100B further including first and second sets 600, 602 of multiple cylindrical x-ray lenses 102 in accordance with the preferred embodiment.

While the present invention has been described with reference to the details of the embodiments of the invention shown in the drawing, these details are not intended to limit the scope of the invention as claimed in the appended claims.

What is claimed is:

1. A method of making compound x-ray lenses comprising the steps of:

forming by extrusion an elongated strip of multiple cylindrical x-ray lenses, said elongated strip containing a series of aligned cavities defining said cylindrical x-ray lenses, and adjacent cavities forming each said cylindrical x-ray lens having opposing, predefined vertical cavity profiles for x-ray focusing.

2. A method of making compound x-ray lenses as recited in claim 1 wherein said opposing, predefined vertical cavity profiles for x-ray focusing includes one of a parabolic profile or a circular profile.

3. A method of making compound x-ray lenses as recited in claim 1 wherein the step of forming by extrusion an elongated strip of multiple cylindrical x-ray lenses includes the step of forming by extrusion said elongated strip of multiple cylindrical x-ray lenses of a selected material; said selected material including materials having a low atomic number for low energy x-rays and other materials for higher energy x-rays.

4. A method of making compound x-ray lenses as recited in claim 3 wherein said selected material is selected from the group including lithium, aluminum, plastic, ceramic, and compounds.

5. A method of making compound x-ray lenses as recited in claim 1 wherein the step of forming by extrusion an elongated strip of multiple cylindrical x-ray lenses includes the step of forming by extrusion said elongated strip of multiple cylindrical x-ray lenses having predefined wall thickness between adjacent cylindrical x-ray lenses.

6. A method of making compound x-ray lenses as recited in claim 5 wherein said predefined wall thickness is provided in a range between 10 $\mu$m and 200 $\mu$m.

7. A method of making compound x-ray lenses as recited in claim 1 wherein said multiple cylindrical x-ray lenses include a number of cylindrical x-ray lenses in a range between 5 and 30.

8. A method of making compound x-ray lenses as recited in claim 1 further includes the steps of providing multiple strips of multiple cylindrical x-ray lenses having a substantially uniform length, and positioning said substantially uniform length strips of multiple cylindrical x-ray lenses in substantial alignment within a support member to provide an initial assembly.

9. A method of making compound x-ray lenses as recited in claim 8 further includes the steps of cutting said initial assembly by electric discharge machining (EDM) to form a variable focus x-ray lens assembly having at least one selected angle of decreasing lengths of a series of cylindrical x-ray lenses.

10. A method of making compound x-ray lenses as recited in claim 9 further includes the steps of selectively providing a horizontal position of said variable focus x-ray lens assembly for selectively and continuously focusing an incident x-ray beam vertically at different locations.

11. A method of making compound x-ray lenses as recited in claim 1 wherein the step of forming by extrusion an elongated strip of multiple cylindrical x-ray lenses includes the step of forming at least one channel spaced apart from said multiple cylindrical x-ray lenses in said elongated strip; said at least one channel including a cooling channel.

12. A method of making compound x-ray lenses as recited in claim 1 includes the steps of processing said elongated strip of multiple cylindrical x-ray lenses; said processing including one or more selected steps of stretching said elongated strip of multiple cylindrical x-ray lenses; and etching said multiple cylindrical x-ray lenses.

13. A variable focus x-ray lens assembly comprising:

a series of cylindrical x-ray lenses formed by at least one extruded strip member including multiple cylindrical x-ray lenses; each said cylindrical x-ray lens have predefined vertical cavity profiles for x-ray focusing;

a support member defining a slot receiving said series of cylindrical x-ray lenses; and said support member and said series of cylindrical x-ray lenses forming at least one selected angle for providing decreasing lengths of said series of cylindrical x-ray lenses from an x-ray receiving side to an opposing side of the variable focus x-ray lens assembly.

14. A variable focus x-ray lens assembly as recited in claim 13 wherein said predefined vertical cavity profiles for x-ray focusing include one of a parabolic profile or a circular profile.

15. A variable focus x-ray lens assembly as recited in claim 13 wherein said at least one extruded strip member including multiple cylindrical x-ray lenses is formed of a selected material, said selected material including materials having a low atomic number for low energy x-rays and other materials for higher energy x-rays.

16. A variable focus x-ray lens assembly as recited in claim 15 wherein said selected material is selected from the group including lithium, beryllium, boron, carbon, aluminum, silicon, plastic, and compounds.

17. A variable focus x-ray lens assembly as recited in claim 13 wherein said series of said cylindrical x-ray lenses includes a number of said cylindrical x-ray lenses in a range between 20 and 300.

18. A variable focus x-ray lens assembly as recited in claim 13 wherein said extruded strip member includes a number of cylindrical x-ray lenses in a range between 5 and 30.

19. A variable focus x-ray lens assembly as recited in claim 13 wherein said extruded strip member includes at least one channel spaced apart from said multiple cylindrical x-ray lenses in said extruded strip.

20. A variable focus x-ray lens assembly as recited in claim 13 wherein said extruded strip member includes a second series of said cylindrical x-ray lenses formed by said at least one extruded strip member.

* * * * *